United States Patent [19]

Bambacigno et al.

[11] Patent Number: 4,986,436

[45] Date of Patent: Jan. 22, 1991

[54] ABOVE GROUND LIQUID STORAGE SYSTEM WITH OVERFILL RESERVOIR

[75] Inventors: Ralph Bambacigno, Modesto; Thomas R. Lindquist, Denair, both of Calif.

[73] Assignee: Convault Inc., Denair, Calif.

[21] Appl. No.: 424,277

[22] Filed: Oct. 20, 1989

[51] Int. Cl.[5] ..... B65B 3/06

[52] U.S. Cl. ..... 220/86 R; 220/18; 141/86

[58] Field of Search ..... 220/86 R, 85 F, 85 S, 220/18, 1 B; 141/86; 137/590, 590.5, 592, 264

[56] References Cited

U.S. PATENT DOCUMENTS

| | | | |
|---|---|---|---|
| 2,233,508 | 3/1941 | Baird et al. | 220/85 S |
| 2,237,462 | 4/1941 | Tokheim | 220/85 S |
| 2,602,465 | 7/1952 | Goehring | 137/592 X |
| 3,514,913 | 6/1970 | Nelson | 220/18 X |
| 4,527,708 | 7/1985 | Dundas et al. | 220/18 |
| 4,615,362 | 10/1986 | Hartman et al. | 141/86 |
| 4,637,522 | 1/1987 | Klop | 220/86 R X |
| 4,655,361 | 4/1987 | Clover et al. | 220/86 R X |
| 4,696,330 | 9/1987 | Raudman et al. | 220/85 F X |
| 4,717,036 | 1/1988 | Dundas et al. | 220/18 |
| 4,770,317 | 9/1988 | Podgers et al. | 220/86 R |
| 4,807,675 | 2/1989 | Sharp | 141/86 |
| 4,809,866 | 3/1989 | Crocker | 220/86 R |
| 4,850,389 | 7/1989 | Moss | 220/18 X |
| 4,856,564 | 8/1989 | Obal | 220/86 R X |
| 4,896,705 | 1/1990 | Podgers et al. | 220/86 R X |

*Primary Examiner*—Steven M. Pollard

*Attorney, Agent, or Firm*—Townsend and Townsend

[57] ABSTRACT

An above-ground liquid storage system (2) includes a steel inner container (4) encased within a layer (6) of reinforced concrete. The steel container has an upper opening (12) in an upper wall (10) thereof. An overfill reservoir (14) is positioned within the container below the upper opening so that the contents of the overfill reservoir are protected by virtue of being within, rather than outside of, the container. A fill pipe (18) extends through the overfill reservoir to permit user to introduce a liquid, such as gasoline or fuel, into the container. The fill pipe has an upper end (26) positioned above the upper opening and a lower end (22) positioned below the upper opening. An upper barrier (40), including a cylindrical wall (30) covered by a removable cover (34) to define an operating region (43) above the upper opening, is used to seal the upper opening. The overfill reservoir has a normally sealed drain (44); overfill liquid within the overfill reservoir is drained into the interior (16) of the container by the user opening a normally closed drain valve (46).

21 Claims, 3 Drawing Sheets

ABOVE GROUND LIQUID STORAGE SYSTEM WITH OVERFILL RESERVOIR

BACKGROUND OF THE INVENTION

Fuel storage tanks are often buried underground for reasons of safety. These underground tanks are filled from the surface through a fill pipe. The upper end of the fill pipe is often housed within a covered enclosure. This protects the fill pipe upper end from damage while providing easy access to the upper end when it is desired to refill the underground tank. Fill nozzles used to fill the underground tanks typically have automatic shutoff valves similar to those used at retail gasoline stations. On occasion the automatic shutoff valves either do not work quickly enough or do not work at all so that fuel overspills the upper end of the fill pipe. To prevent contamination of the surrounding area, overfill protection systems have been developed for these underground tanks. Typically an overfill catch basin is mounted around the fill pipe between the upper and lower ends of the fill pipe to catch the overspill. The overspill can then be pumped back into the main tank (see U.S. Pat. No. 4,655,361 to Clover, et al.) or drained back into the tank (see U.S. Pat. No. 4,637,522 to Klop).

SUMMARY OF THE INVENTION

The present invention is directed to an above ground liquid storage system with an overfill reservoir situated within the interior of the container. Any liquid within the overfill reservoir is therefore protected in the same manner as the other contents of the container interior.

The above-ground liquid storage system includes an above-ground liquid storage container having an upper opening in the upper wall thereof. An overfill reservoir is positioned within the interior of the container below the upper opening. A fill pipe preferably extends upwardly through the overfill reservoir to permit user to introduce a liquid, such as gasoline or other fuel, into the container. The fill pipe preferably has an upper end positioned above the upper opening and a lower end positioned below the upper opening.

An upper barrier is used to enclose or seal the upper opening in the vicinity around the upper end of the pipe. The upper barrier has a removable cover which provides user access to the upper end of the fill pipe. During filling operations liquid may overflow the upper end of the fill pipe into the overfill reservoir within the interior of the liquid storage container.

The overfill reservoir preferably has a drain at a low point of the reservoir. The drain is normally sealed by a drain valve so that overfill liquid within the overfill reservoir is drained into the interior of the drain by the user opening the normally closed drain valve. The drain valve is configured so that the overfill reservoir remains sealed from the container interior during an overpressure within the container interior.

One of the primary advantages of the invention is that since the overfill reservoir is housed within the container, protection normally given the contents of the container is also given the contents of the overfill reservoir. Thus, when the container is a steel container encased within, for example, six inches of reinforced concrete, the reinforced concrete not only provides physical but also thermal protection for the contents of the overfill reservoir.

Another advantage of the invention lies in the provision of the lower end of the fill pipe at a position a chosen distance below the upper wall of the container. Thus, when the user notices that the fuel in the container is at the lower end of the fill pipe, further fuel may be introduced slowly in a controlled manner. This contrasts with prior below ground systems which provide very little warning that the below ground tank is full; once the fuel fills the below ground tank, it very quickly fills up the relatively small diameter fill pipe with very little warning to the user, thus increasing the chance of a spill.

Other features and advantages of the invention will appear from the following description in which the preferred embodiment has been set forth in detail in conjunction with the accompanying drawing.

DETAILED DESCRIPTION OF THE PREFERRED EMBODIMENT

Figure 1:
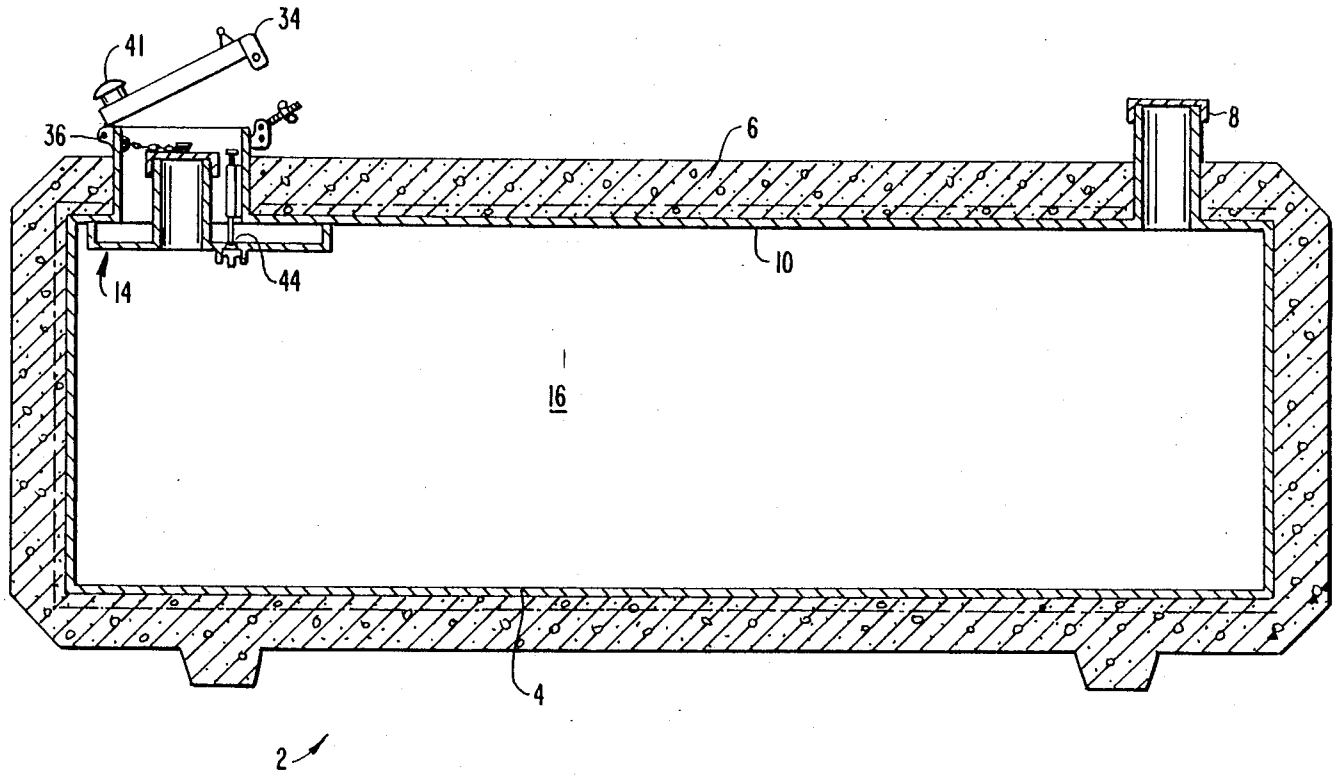
FIG. 1 is a simplified cross-sectional view of an above ground liquid storage tank made according to the invention.

At FIG. 1 a cross-sectional view of an above ground liquid storage system or tank 2 is seen to include a steel container 4 encased within a reinforced concrete layer 6. Tank 2 may be made in the manner disclosed in U.S. Pat. No. 4,826,644, issued May 2, 1989, the disclosure of which is incorporated by reference. Tank 2 includes an emergency vent 8 which relieves dangerous high pressure conditions within tank 2, such as could occur if tank 2 were in a sustained fire.

Figure 2:
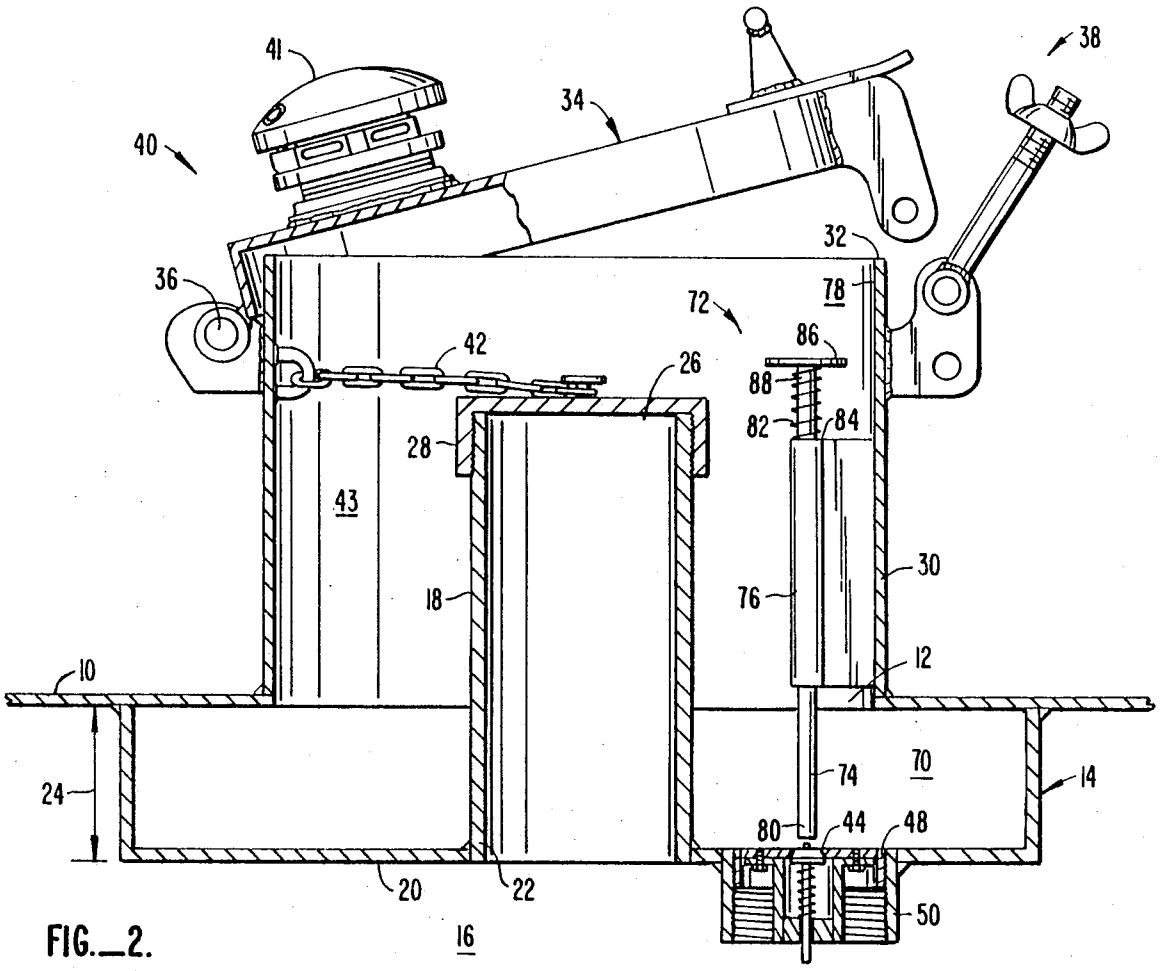
FIG. 2 is an enlarged cross-sectional view of the overfill reservoir, fill pipe and upper barrier of FIG. 1.

Referring now also to FIG. 2, container 4 includes an upper wall 10 having an upper opening 12 formed therein. An overflow reservoir 14 is secured to upper wall 10, such as by welding, and extends within the interior 16 of container 4. Container 4, in this embodiment, has a capacity of 1,000 gallons while reservoir 14 has a capacity of about 7 to 12 gallons. The invention may be carried out with other sizes as well.

A fill pipe 18 is mounted to the bottom 20 of reservoir 14 and has its lower open end 22 aligned with bottom 20 so that lower open end 22 extends a distance 24, typically three inches, below upper wall 10. Fill pipe 18 has an open upper end 26 which is normally sealed by a threaded cap 28.

A cylindrical wall 30 is secured to upper wall 10 to surround upper opening 12, such as by welding. Cap 28 is secured to wall 30 by a chain 42 to keep cap 28 from getting lost. The top edge 32 of wall 30 is spaced apart above open upper end 26. A hinged cover 34 is mounted to wall 30 at pivot 36 to permit top edge 32 to be sealed. A latch mechanism 38 permits cover 34 to be locked in a closed position to prevent tampering. Cover 34, wall 30 and latch mechanism 38 together constitute an upper barrier 40 which seals upper opening 12 from the ambient environment. Cover 34 includes a pressure/vacuum relief valve 41, such as one made by Central Illinois Mfg. Co. of Bement, Ill. as fill cap part no. 50, to limit the pressure differential between the interior 43 of barrier 40 and the ambient atmosphere.

Figure 3:
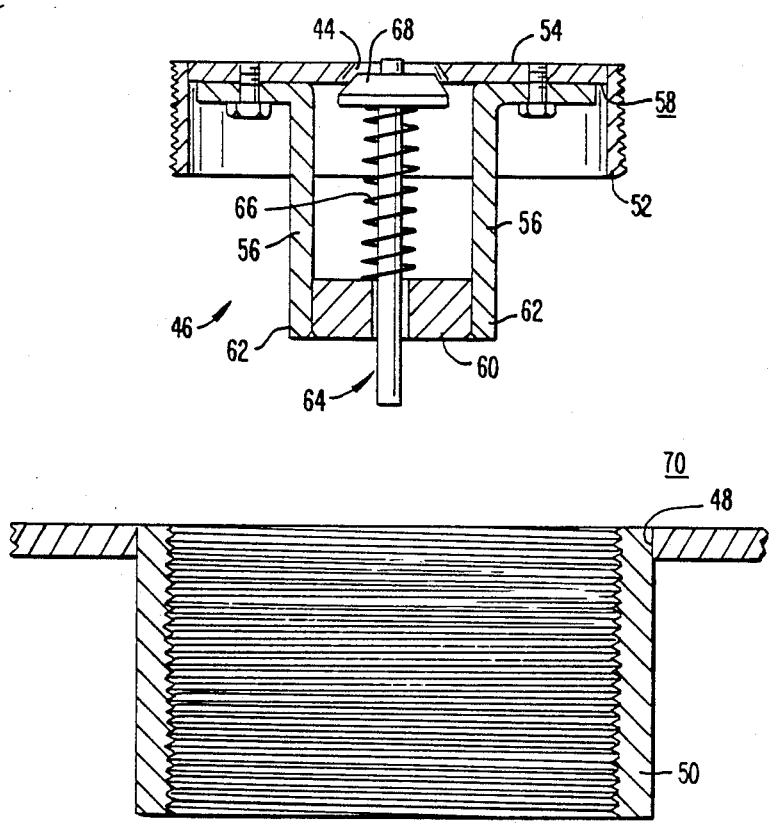
FIG. 3 is an enlarged, exploded cross-sectional view of the drain valve assembly of FIG. 2.

Reservoir 14 includes a drain 44 formed in bottom 20. Drain 44 is defined by a drain valve assembly 46, shown in more detail in FIG. 3. Bottom 20 includes an opening 48 within which a cylindrical, internally-threaded coupling 50 is secured, typically by welding. Drain valve assembly 46 includes a cylindrical, externally-threaded coupling 52 which threadably engages coupling 50 to permit the drain valve assembly to be easily removed from reservoir 14 for repair or replacement. Assembly 46 includes a valve seat 54 defining drain 44. A pair of L legs 56 are bolted to the lower surface 58 of valve seat 54 and have a cylindrical bushing 60 secured to and between the lower ends 62. A valve stem and disk valve assembly 64, such as made by Minnesota Rubber Company as disk valve 514AD, is mounted between legs 56; a spring 66 biases disk valve 68 against conformingly-shaped drain 44. (Disc valve 68 is shown spaced-apart from drain 44 in FIG. 3 to better illustrate the drain.)

Drain valve assembly 46 is thus normally closed with the strength of spring 66 sufficient to seal drain 44 even when reservoir 14 fills with a liquid. However, the complementary tapered shapes of disk valve 68 and drain 44 keeps drain 44 closed whenever overpressure of interior 16 relative to the inside 70 of reservoir 14 exists.

Drain 44 is opened by actuating a drain value actuator 72. Actuator 72 includes a rod 74 mounted within and guided by a vertical guide 76 which is secured to the inside surface 78 of cylindrical wall 30. The lower end 80 of rod 74 is biased away from assembly 64 by a coil spring 82 mounted between the upper end 84 vertical guide 76 and a disk like handle 86 secured to the upper end 88 of rod 74.

To fill interior 16 of container 4, the user releases latch mechanism 38 and pivots cover 34 away to expose fill pipe 18. Cap 28 is removed and the fill spout (not shown) inserted into upper end 26 of fill pipe 18. Fill pipe 18 is, in this preferred embodiment, about 9 inches long and is sized so that the outer end of the fill spout is about even with lower open end 22 of the fill pipe. This permits the user to accurately judge when the level of liquid within interior 16 reaches lower open end 22 of fill pipe 18. When it does so, the fill spout may be removed a short distance so to continue filling that portion of interior 16 above bottom 20 of reservoir 14.

On occasion, the liquid being introduced into interior 16 may spill over open upper end 26 during filling operations. If so, the overfill liquid will spill through interior 43 of barrier 40 and into inside 70 of reservoir 18. If the level of the liquid in container 4 is below bottom 20, the user can then depress end 86 of drain valve actuator 72 to permit the liquid within inside 70 of reservoir 14 to drain into interior 16. However, when overfill occurs, it often occurs because the level of liquid within interior 16 is above bottom 20. In such cases user will replace cap 28 and relatch cover 24 with the spill over liquid within reservoir 14. Reservoir 14, being within interior 16 of steel container 10, enjoys the protective advantages created by steel container 4 and by reinforced concrete layer 6. This is in contrast with situations in which the spill over reservoir is external of the main container. After sufficient liquid has been drawn from interior 16 of container 4, the user can depress drain valve actuator 72 to permit the liquid within inside 70 of reservoir 14 to drain through drain 44 and into interior 16.

Modification and variation can be made to the disclosed embodiment without departing from the subject of the invention as defined in the following claims. For example, although steel container 4 is a container with a flat upper wall 10, container 4 could be other shapes, such as cylindrical with a curved upper wall. With tank 2 lower open end 22 is flush with bottom 20 of reservoir 14; it could, however, extend below bottom 20 if desired. If desired, tank 2 could include a pump system for purging spill over liquid out of reservoir 14 to an external container or into interior 16 even when the liquid level is above drain 44. Also, fill pipe 18 need not extend from bottom 20 of reservoir 14.

What is claimed is:

1. An improved above ground liquid storage system comprising:

an above ground liquid storage container having an interior and an upper wall with an upper opening in the upper wall;

an overfill reservoir positioned within the interior of the container and below the upper opening;

a fill pipe extending upwardly from the overfill reservoir, the fill pipe having a lower end opening into the container interior and an upper end;

an upper barrier secured to the upper wall at the upper opening, the barrier extending above the upper opening so to seal the upper opening; and the upper barrier including a removable member to provide user access to the upper end of the fill pipe.

2. The system of claim 1 wherein the fill pipe upper end is external of the container interior.

3. The system of claim 1 wherein the container is a concrete encased steel tank.

4. The system of claim 1 wherein the reservoir includes a low point and further comprising a drain at the low point.

5. The system of claim 4 wherein the fill pipe is about 9 inches long with the open lower end about 3 inches below the container upper opening.

6. The system of claim 4 wherein the drain is a remotely actuated drain.

7. The system of claim 4 further comprising means for normally sealing said drain and user actuated means for selectively opening the sealing means so to permit overfill liquid in the overfill reservoir to drain into the container interior.

8. The system of claim 7 wherein the sealing means include means for sealing the drain against fluid flow between the container interior and the overfill reservoir due to an overpressure in the container interior relative to the pressure in the overfill reservoir.

9. The system of claim 1 wherein the overfill as a bottom and the lower end of the fill pipe is the bottom of the overfill reservoir.

10. The system of claim 9 wherein the lower end of the fill pipe is positioned within the container interior at a chosen elevation.

11. The system of claim 10 wherein the chosen elevation passes through a horizontal plane which divides the container interior into an upper region and a lower region.

12. The system of claim 11 wherein the bottom of the overfill reservoir is generally coincident with said horizontal plane.

13. The system of claim 1 further comprising a fill pipe cap removably secured to the fill pipe upper end.

14. The system of claim 1 wherein the upper barrier includes a pressure/vent valve which limits the pressure differential between the inside of the upper barrier and the ambient atmosphere.

15. The system of claim 1 wherein the upper barrier includes a circumferential wall having an open upper end to which the removable member is pivotally secured.

16. An improved above ground liquid storage system comprising:

an above ground liquid storage container having an interior and an upper wall and an upper opening in the upper wall;

an overfill reservoir housed within the interior and opening into the upper opening;

a fill pipe having a lower end opening into the container interior and an upper end; and means for selectively sealing the upper opening and the upper end of the fill pipe from the ambient environment;

whereby the container can be filled through the fill pipe, and whereby liquid which may overflow the upper end of the fill pipe passes into the reservoir.

17. The storage system of claim 16 wherein the fill pipe lower end is positioned a chosen distance below the upper opening.

18. The storage system claim 16 further comprising means for draining a liquid in the overfill reservoir into the container interior.

19. The storage system of claim 16 wherein the container is a thermally insulated container.

20. The storage system of claim 19 wherein the container includes a steel inner container and a reinforced concrete outer layer.

21. The storage system of claim 16 wherein the selectively sealing means defines an operating region above the container upper opening and wherein the upper end opens into the operating region, whereby the overflow liquid through the operating region, through the upper opening and into the reservoir.

* * * * *

UNITED STATES PATENT AND TRADEMARK OFFICE

CERTIFICATE OF CORRECTION

PATENT NO. : 4,986,436

DATED : January 22, 1991

INVENTOR(S) : Bambacigno et al.

It is certified that error appears in the above-identified patent and that said Letters Patent is hereby corrected as shown below:

Title page, item [21], delete "424,277" and replace with --424,772-- .

Signed and Sealed this

Nineteenth Day of May, 1992

*Attest:*

DOUGLAS B. COMER

*Attesting Officer*

*Acting Commissioner of Patents and Trademarks*